United States Patent [19]

Piazza

[11] 4,175,867

[45] Nov. 27, 1979

[54] PROCESS AND APPARATUS FOR STATIC MIXING

[75] Inventor: Matthew R. Piazza, Nichols, Conn.

[73] Assignee: Maso-Therm Corp., Bridgeport, Conn.

[21] Appl. No.: 882,484

[22] Filed: Mar. 1, 1978

[51] Int. Cl.[2] ..... B01F 15/02

[52] U.S. Cl. ..... 366/9; 366/337

[58] Field of Search ..... 366/9, 10, 40, 336, 366/337, 341; 138/40, 42, 38

[56] References Cited

U.S. PATENT DOCUMENTS

| | | | |
|---|---|---|---|
| 3,190,618 | 6/1965 | Katzen | 366/337 |
| 3,743,250 | 7/1973 | Fitzhugh et al. | 366/337 |
| 3,770,250 | 11/1973 | Uchida | 366/168 |
| 3,923,288 | 12/1975 | King | 366/336 |
| 4,034,965 | 7/1977 | King | 366/336 |

*Primary Examiner*—Leonard D. Christian

*Attorney, Agent, or Firm*—Sprung, Felfe, Horn, Lynch & Kramer

[57] ABSTRACT

A process and apparatus for the static mixing of materials, preferably to produce glass fiber reinforced cement and concrete, comprises a static mixing column having a plurality of static mixing elements therein and a chamber at the top thereof and in communication therewith and into which solid materials to be mixed are fed. Liquid to be mixed with the solid material is sprayed in the column all along the length thereof.

6 Claims, 4 Drawing Figures

PROCESS AND APPARATUS FOR STATIC MIXING

BACKGROUND OF THE INVENTION

The present invention relates to a process and apparatus for the static mixing of materials, preferably glass or other fiber reinforced cement or concrete. Rotary batch mixing devices for concrete are well known in the construction industry. These devices have the disadvantages of being complex and requiring a great deal of energy to operate and therefore are costly when used on site in a construction project. Additionally, these devices do not permit a continuous feed and mixing of cement with a continuous output for high volume use.

SUMMARY OF THE INVENTION

The present invention provides an efficient and economical process and apparatus for the static mixing of materials preferably glass or other fibers reinforced cement or concrete.

The present invention also provides process and apparatus for the static mixing of materials which permit feeding and mixing to be performed continuously for high volume outputs.

The present invention further provides process and apparatus wherein liquid is efficiently and effectively added to solid materials being mixed to provide a superiorly mixed end product.

These are achieved by the process of the present invention which comprises providing a static mixing elements therein and an input chamber at the top thereof in communication with the column, feeding solid materials to be mixed into the chamber and spraying liquid to be mixed with the solid material into the column all along the length thereof.

The liquid is sprayed radially inwardly from the inner wall of the column and/or radially outwardly from the center of the column.

For the mixing of reinforced cement, sand and cement are fed to the chamber, while at least one of water and additives are fed for spraying into the column individual lengths of fibers are dropped preferably by directly chopping into the chamber for mixing with the sand and cement.

The apparatus of the present invention comprises a static mixing column having a plurality of static mixing elements therein, spraying means disposed along the length of the column and having a plurality of spraying apertures therein and receptive to liquid for spraying same through the apertures and into the material being mixed in the column to mix therewith and an input chamber disposed at the top of the column and in communication with the column and receptive of the materials to be mixed in the column.

The spraying means comprises a pipe disposed along the longitudinal axis of the column and having the apertures therein and/or a jacket disposed around and including the inner wall of the column and wherein the apertures are disposed around the inner wall of the and in communication with the jacket. When both the jacket and pipe are used, they are preferably in liquid communication with each other.

For the mixing of fiber reinforced cement, means are provided for effecting delivery of materials to the chamber comprising a first delivery pipe receptive of sand and feeding into the input chamber, a fiber chopper receptive of fiber lengths and disposed on top of the chamber for dropping chopped fibers therein, and at least one of water and additives fed to the spraying means for spraying same into the column for mixing with the other materials in the column.

BRIEF DESCRIPTION OF THE DRAWINGS

The structure and advantages of the present invention will be more clearly understood with reference to the drawings wherein.

DETAILED DESCRIPTION OF THE INVENTION

Figure 1:
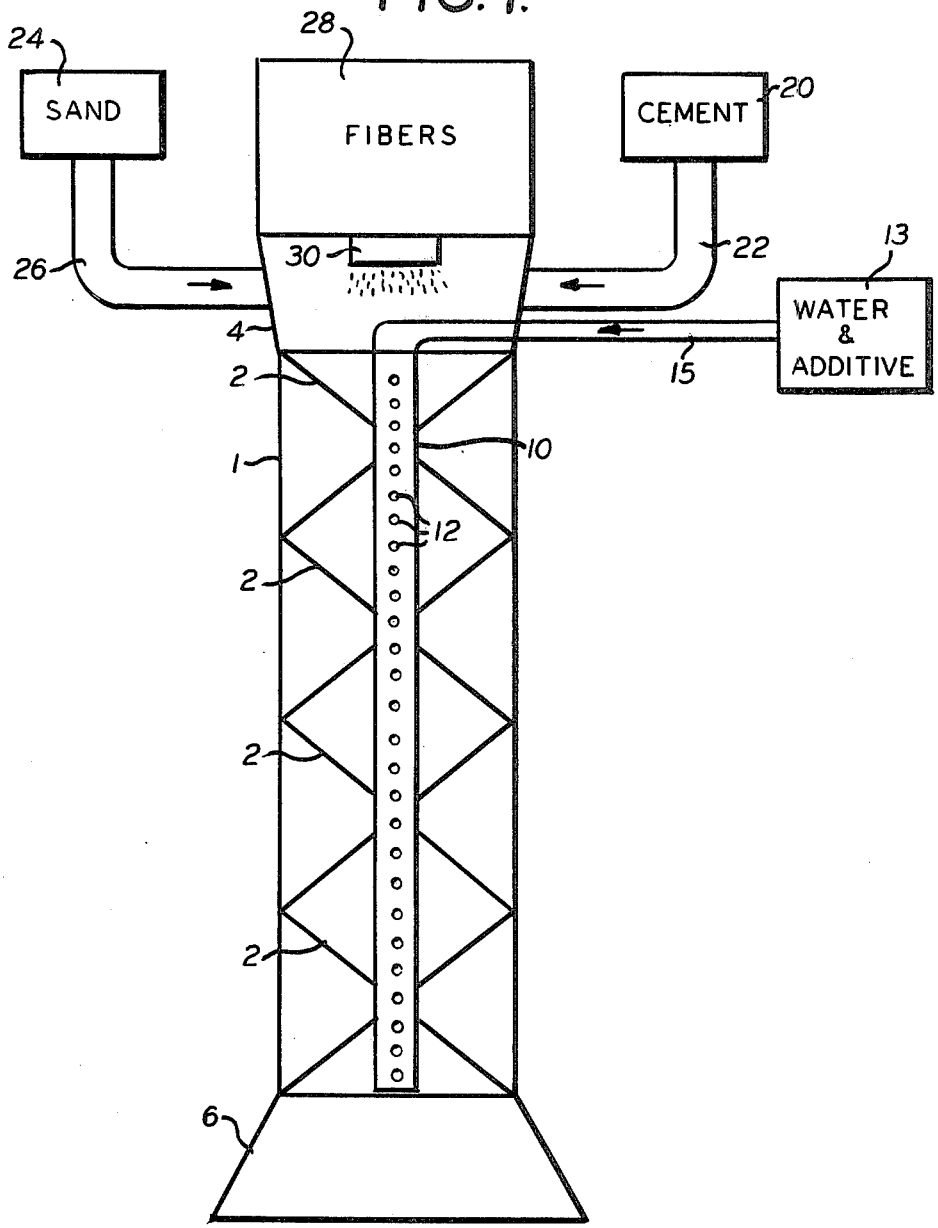
FIG. 1 is a schematic view of one embodiment of the present invention.

Referring now to FIG. 1, a static mixing column 1 has a plurality of static mixing elements therein. Mixing elements are preferably of the self-nesting and axially overlapping type which can be fitted into the mixing column, such as those described in U.S. Pat. Nos. 3,923,288 and 4,034,965.

Disposed centrally of the mixing column 1 and extending along the whole longitudinal length thereof, is pipe 10 having apertures 12 therein. The pipe 10 extends through the static mixing elements in a manner similar to that shown in U.S. Pat. No. 3,743,250 and is receptive of liquids such as water preferably with additives through connecting pipe 15 from source 13. The apertures 12 in pipe 10, can be selectively spaced or configured to effect a controlled radially outward spraying into the column such as is desired for the materials being mixed. For example, for mixing of reinforced cement, it is preferable that little water and additives are added at the top of the column and that the water be progressively increased towards the bottom of the column.

An input chamber 4 is disposed at the top of the column 1 for receiving the materials to be mixed in the column. Input chamber 4 is in communication with the column 1 and as materials are fed therein they are thereafter fed into the column. An output chamber 6 is optionally disposed at the base of the column for receiving the mixed material.

The column itself may be stationary and have a car, such as a cement car, disposed therebelow and movable with respect thereto, in order to deliver the mixed cement or other material to the mold or site at which it is needed. Alternatively, the entire mixing apparatus can be movably mounted on wheels above a mold or a site so that the mixed material can be distributed while the mixing apparatus is moving and while materials to be mixed are continuously fed therein.

In the embodiment wherein fiber reinforced cement is to be mixed in the column 1, as shown in FIG. 1, a source of sand 24 is fed via pipe 26 into the chamber 4. Additionally, a source of cement 20 feeds cement into the chamber 4 via pipe 22. Reinforcing fibers are also fed from a fiber source 28 and in a preferred embodiment, a fiber chopper 30 is disposed at the top of the chamber 4, and is receptive of the fibers from source 28 to chop the fibers and drop them into the chamber 4, with the fed in sand and cement. As the sand, cement and fibers travel down the mixing column 1, water and additives are fed from source 13 by pipe 15 into spraying pipe 10 and through apertures 12 in order to mix with the solid materials.

Figure 2:
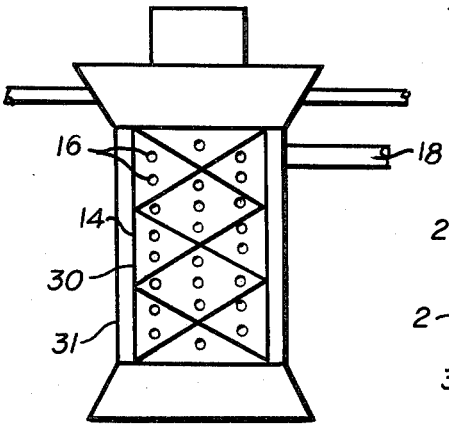
FIG. 2 is a schematic view of another embodiment of the invention.

In a alternative embodiment in FIG. 2, the spraying is carried out radially inwardly from a jacket 14 including the wall 30 of the column 1 as the inner wall which has apertures 16 therein and an outer wall 31. Water and additives, or any other desired liquid is fed through pipe 18 into the jacket 14 and the liquid is then sprayed from the apertures 16 into the column 1.

Figure 4:
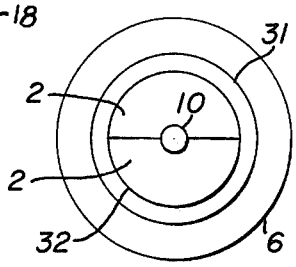
FIG. 4 is a sectional view taken along 4—4 in FIG. 3.
Figure 3:
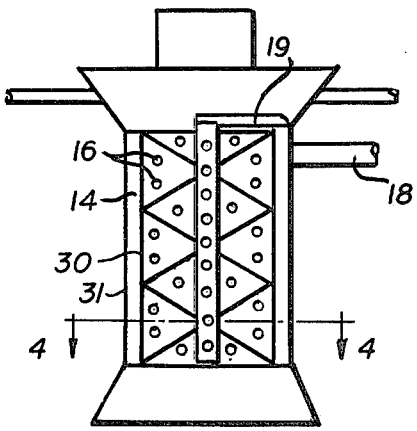
FIG. 3 is a schematic view of a still further embodiment of the invention.

In the embodiment shown in FIGS. 3 and 4, both spraying pipe 10 and spraying jacket 14 are used and are in liquid communication with each other by means of pipe 19. In this way liquid is sprayed radially outwardly from the center of the mixing column and radially inwardly from the outer periphery to effect a complete wetting of the materials to be mixed.

While the present invention has been described with respect to various specific embodiments, it is to be understood that modifications to the disclosed embodiments can be made within the spirit of the invention and this will be apparent to those of ordinary skill in the art. For example, the materials to be mixed which are fed to the chamber 4 may also include some liquids, while other liquids are added via the spraying means. Additionally, the input of materials to the input chamber can be metered to provide a desired rate of input of materials and therefore a desired rate of output of materials.

What is claimed is:

1. A static mixing apparatus comprising:

a static mixing column having a plurality of static mixing elements therein;

spraying means disposed along the length of the column and having a plurality of spraying apertures therein and receptive of liquid for spraying same through the apertures and into material to be mixed in the column to mix therewith wherein the spraying means comprises a jacket disposed around and including inner the wall of the column and wherein the apertures are disposed in the inner wall of the column and in communication with the jacket; and a chamber disposed at the top of the column and in communication therewith and receptive of the materials to be mixed in the column.

2. The apparatus according to claim 1 wherein the spraying means further comprises a pipe disposed through the static mixing elements along the central longitudinal axis of the column and means connecting the pipe to the jacket to put the pipe in liquid communication with the jacket and the spraying apertures therein.

3. A process for the static mixing of materials comprising:

providing a static mixing column having a plurality of static mixing elements therein, a chamber at the top thereof and in communication therewith and a jacket disposed therearound which includes the inner wall of the column;

feeding solid materials to be mixed into the chamber;

feeding liquid to be mixed with the solid material into the jacket; and spraying the liquid from the jacket into the column radially inwardly from all around the inner wall of the column all along the length thereof.

4. The process according to claim 3, wherein the liquid is also sprayed radially outwardly from the center of the column.

5. A static mixing apparatus for the mixing of fiber reinforced cement comprising:

a static mixing column having a plurality of static mixing elements therein;

spraying means disposed along the length of the column and having a plurality of spraying apertures therein and receptive of liquid for spraying same through the apertures and into material to be mixed in the column to mix therewith;

a chamber disposed at the top of the column and in communication therewith and receptive of the materials to be mixed in the column; and means for effecting delivery of materials to the chamber comprising a first delivery pipe receptive of cement and connected to the chamber, a fiber chopper receptive of fiber lengths and disposed on top of the chamber for dropping chopped fibers therein and wherein the spraying means is receptive of at least one of water and additives to spray same into the column for mixing with the other materials in the column.

6. A process for the static mixing of fiber reinforced cement comprising:

providing a static mixing column having a plurality of static mixing elements therein and a chamber at the top thereof and in communication therewith;

feeding sand and cement to be mixed into the chamber;

feeding at least one of water and additives for spraying into the column;

spraying water and additives to be mixed with the sand and cement into the column all along the length thereof; and chopping fibers and dropping same into the chamber.

* * * * *